United States Patent [19]

Smirmaul

[11] Patent Number: 4,744,558

[45] Date of Patent: May 17, 1988

[54] DOWNHILL SKI EXERCISE DEVICE

[76] Inventor: Heinz J. Smirmaul, 1307 Brookstone La., Duncanville, Tex. 75137

[21] Appl. No.: 93,296

[22] Filed: Sep. 4, 1987

Related U.S. Application Data

[63] Continuation-in-part of Ser. No. 62,869, Jun. 16, 1987.

[51] Int. Cl.[4] ..... A63B 69/18

[52] U.S. Cl. ..... 272/97; 434/253

[58] Field of Search ..... 272/69, 70, 97, 146, 272/132; 434/253

[56] References Cited

U.S. PATENT DOCUMENTS

| | | | |
|---|---|---|---|
| 2,274,081 | 2/1942 | Mautin | 272/57 |
| 2,906,532 | 9/1959 | Echols | 272/57 |
| 3,461,857 | 8/1969 | Poulin | 128/25 |
| 3,565,424 | 2/1971 | Macabet et al. | 272/80 |
| 3,582,066 | 6/1971 | Keryluk | 272/57 |
| 3,591,172 | 7/1971 | Hude | 272/57 |
| 3,707,283 | 12/1972 | Cormier | 272/57 B |
| 3,708,163 | 1/1973 | Hynes | 272/57 B |
| 3,729,207 | 4/1973 | Reynolds | 280/11.2 |
| 3,807,727 | 4/1974 | Ferguson | 272/57 B |
| 3,912,260 | 10/1975 | Rice | 272/57 B |
| 4,023,795 | 5/1977 | Pauls | 272/97 |
| 4,101,136 | 7/1978 | Corll | 272/97 |
| 4,148,477 | 4/1979 | Larson | 272/56.5 SS |
| 4,396,189 | 8/1983 | Jenkins | 272/97 |
| 4,423,864 | 1/1984 | Wiik | 272/97 |
| 4,429,869 | 2/1984 | Eckstein | 272/97 |
| 4,595,195 | 6/1986 | Miehlich | 272/97 |
| 4,607,839 | 8/1986 | Knudson | 272/97 |
| 4,645,202 | 2/1987 | Tomba et al. | 272/97 |
| 4,669,723 | 6/1987 | Arsenian | 272/97 |

FOREIGN PATENT DOCUMENTS 2443695 3/1976 Fed. Rep. of Germany .

*Primary Examiner*—Richard J. Apley
*Assistant Examiner*—S. R. Crow
*Attorney, Agent, or Firm*—Richards, Harris, Medlock & Andrews

[57] ABSTRACT

A ski exercise device (500) includes a stationary mainframe (502) and an arcuate track (520) having first (520*a*) and second (520*b*) ends. The ends (520*a*, 520*b*) of the arcuate track (520) are connected to the stationary mainframe (502). A support platform (540) is slidably mounted to the arcuate track (520). The support platform (540) moves along the arcuate track (520) between the ends (520*a*, 520*b*). Biasing structure (720) biases the support platform (540) to the arcuate track (520) such that the support platform (540) acts against the force created by the biasing structure (720) as the support platform (540) moves along the arcuate track (520). The support platform (540) supports the user of the ski exercise device (500) and allows for rotational and vertical motion of the user's feet during movement along arcuate track (520).

11 Claims, 8 Drawing Sheets

DOWNHILL SKI EXERCISE DEVICE

RELATED APPLICATION

This application is a continuation-in-part of U.S. application Ser. No. 062,869, filed June 16, 1987 and entitled "Downhill Ski Exercise Device."

TECHNICAL FIELD

This invention relates to exercising devices, and more particularly to an exercise device for simulating skiing, especially downhill.

BACKGROUND ART

In recent years, the popularity of snow skiing has greatly increased. Although many individuals have participated in this sport, most people are only occasional skiers and do not take the proper steps necessary before skiing to train themselves and to assure that they are in proper physical condition before taking to the slopes. While ski training and exercising equipment has been provided in the past, such devices have not adequately simulated sufficiently either the actual skiing movements or the forces to be expected during skiing maneuvers.

Downhill, slalom or Alpine skiing as opposed to Nordic or cross country skiing requires the user to carry out unique and strenuous movements while skiing. Generally, these movements include the following: a more or less up-and-down movement; stressing of the outer ski in a curve with a simultaneous lowering of the outer ski; inclination of the skis (edge setting) so that the inner edges of the ski are in contact with the snow in a turn; turning of the feet with the toes facing inwardly in the turn; and the longitudinal shifting of the feet with the inner ski located ahead of the outer ski in a turn. Several motions involve an up-and-down movement with a lowermost position during the making of a turn with the smallest radius. Alternatively, the skier can also lower his body while running straight downhill which involves running with the upper part of the body relatively motionless but with pronounced leg action, particularly involving the muscles of the thighs. Turns are made with pronounced straightening of the knee joints.

In parallel skiing, the skier pumps his legs so as to lower his body, raise his body, and then lower his body again. It is this body movement which unweights the skis, particularly at the rear ends thereof so that the major contact of the skis with the snow surface is at the forward or tip end of the skis. This configuration permits the rear ends of the skis to be moved laterally to the left if the skier is executing a right turn. As the rear ends of the skis are shifted laterally to the left, the skis are rotated slightly about their longitudinal axes so as to raise the left edge portions thereof and the right hand ski is shifted slightly forward of the left ski.

A ski exercising apparatus which is used by downhill skiers must be capable of enabling the user to perform the above-enumerated movements as well as allowing the user to develop coordination and muscle strength. Such an exercising device should present a force which must be overcome by the user who thereby builds his muscles and becomes aware of the conditions under which stressing of certain muscles or groups of muscles takes place during downhill skiing. As with any other type of exercising device, the exercising device must be easy to use to encourage the exerciser to routinely use the device without becoming bored. The more accurately the simulated movements can be reproduced through an exercising device, the greater use of the device will be made with the accompanying benefits to the user.

A need has thus arisen for a downhill ski exercising device which enables the user to perform the various movements actually required in downhill skiing, to thereby strengthen muscles and allow the user to become aware of the conditions under which stressing of certain muscles takes place during actual skiing. Such an exercising device must be simple in construction to allow easy use, minimal maintenance and durable for extended exercising periods.

DISCLOSURE OF THE INVENTION

In accordance with one aspect of the present invention, a ski exercise device includes a frame and a track having first and second ends. The ends of the track are connected to the frame. A platform is slidably mounted to the track for supporting the user of the device and for movement between the first and second ends of the track. Structure is provided for biasing the platform to the track, such that the platform acts against the force created by the biasing structure as the platform moves along the track between the first and second ends of the track.

In accordance with another aspect of the present invention, a frame having first and second ends and lying in a first plane is provided. An arcuate track having first and second ends and a central portion disposed between the first and second ends is connected to the frame. The arcuate track is disposed in a second plane generally perpendicular to the first plane with the central portion of the track disposed above the first plane. A platform is slidably mounted to the track for supporting the user of the device and for movement between the first and second ends of the track. A flywheel is rotatably mounted to the frame. A cable interconnects the flywheel and the platform. Structure is provided for biasing the platform to the track such that the platform has a neutral position when located adjacent to the central portion of the arcuate track and is movable along the arcuate track between the first and second ends by the user of the exercising device by overcoming the force exerted by the biasing structure and the flywheel to thereby impart rotational motion to the flywheel. The platform receives the feet of the user of the device and allows the feet of the user of the device to rotate in the direction of movement of the platform along the arcuate track to thereby simulate up-and-down movements and edge setting.

BRIEF DESCRIPTION OF THE DRAWINGS

For a more complete understanding of the present invention and for further advantages thereof, reference is now made to the following Detailed Description taken in conjunction with the accompanying Drawings, in which.

DETAILED DESCRIPTION

Figure 1:
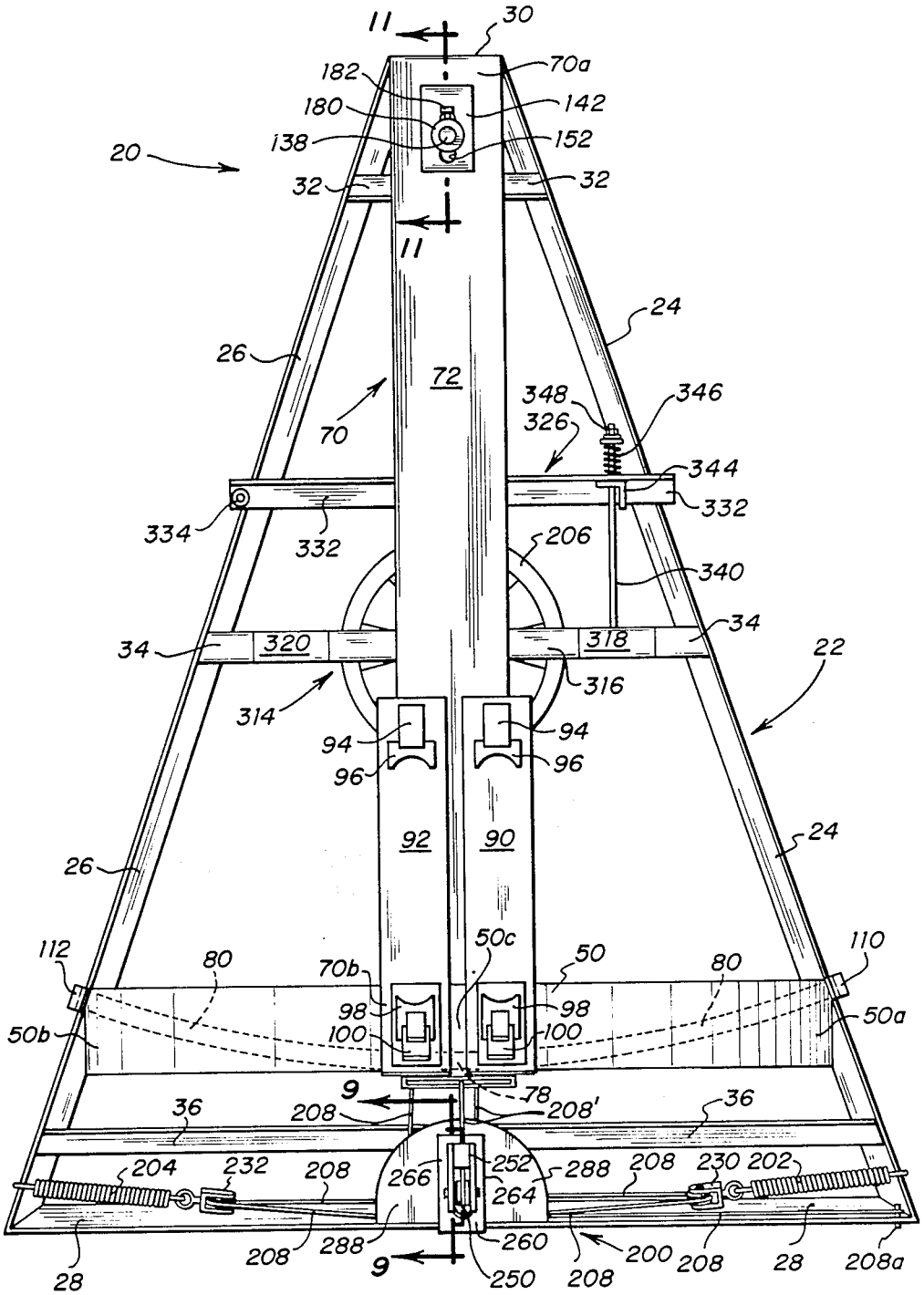
FIG. 1 is a top plan view of a ski exercising device.
Figure 3:
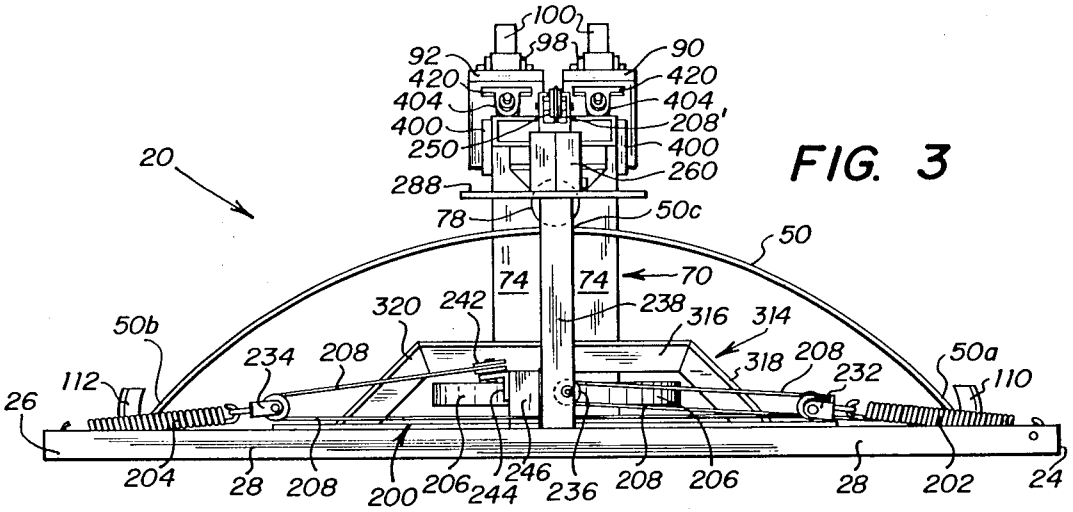
FIG. 3 is a rear elevational view of the ski exercising device illustrated in FIG. 1.
Figure 2:
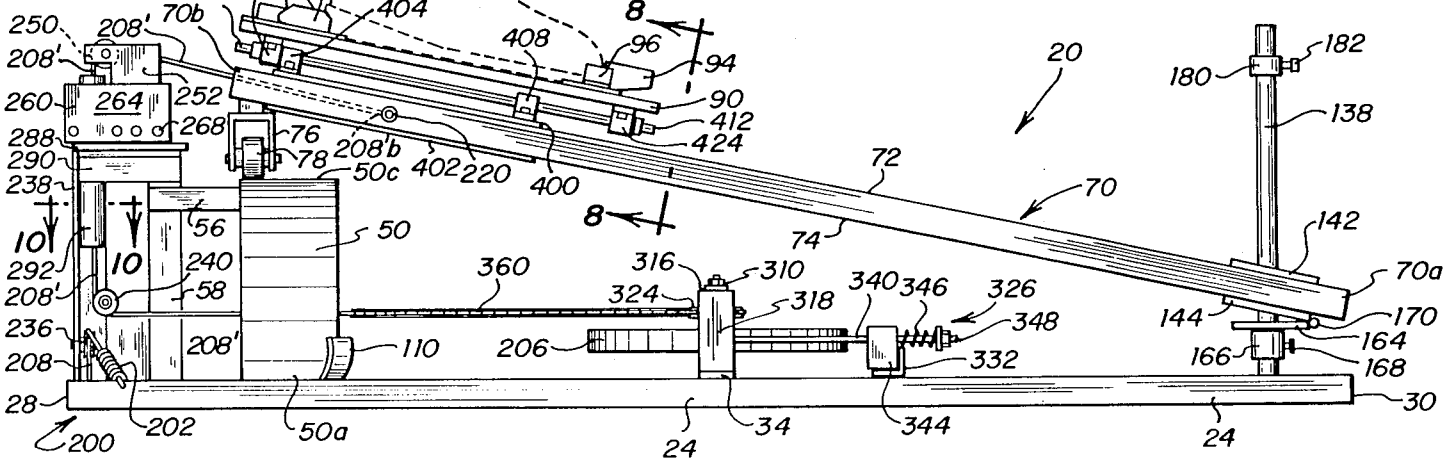
FIG. 2 is a side elevational view of the ski exercising device illustrated in FIG. 1.

Referring simultaneously to FIGS. 1, 2 and 3, a ski exercise device is illustrated and is generally identified by the numeral 20. Ski exercise device 20 can be used for the practice and simulation of skiing, especially for the practice of downhill or slalom runs and for exercising those parts of the body whose conditioning is especially important for a safe and satisfactory downhill ski run. The ski exercise device 20 includes a stationary mainframe, generally identified by the numeral 22 which is disposed in a first plane and which is positioned on the floor for use. Stationary mainframe 22 is generally triangular in configuration and includes side members 24 and 26 and a base member 28. Side members 24 and 26 are interconnected via a top frame member 30, a front transverse member 32, a central transverse member 34 and a rear transverse member 36. The members 24–36 of stationary mainframe 22 may be interconnected by welding, nuts and bolts, or the like.

Ski exercising device 20 includes an arcuately shaped track 50 having ends 50*a* and 50*b* and a central portion 50*c*. As more clearly shown in FIG. 3, arcuate track 50 is disposed in a second plane perpendicular to the plane of stationary mainframe 22. The highest point on arcuate track 50 is central portion 50*c*. Arcuate track 50 is attached to side members 24 and 26 at ends 50*a* and 50*b*, respectively, by welding or the like. The central portion 50*c* of arcuate track 50 is supported by a brace 56 (FIG. 3) extending below arcuate track 50 which is interconnected to a leg 58. Leg 58 is perpendicularly disposed to and interconnected to rear transverse member 36 of stationary mainframe 22 by welding or the like.

Figure 4:
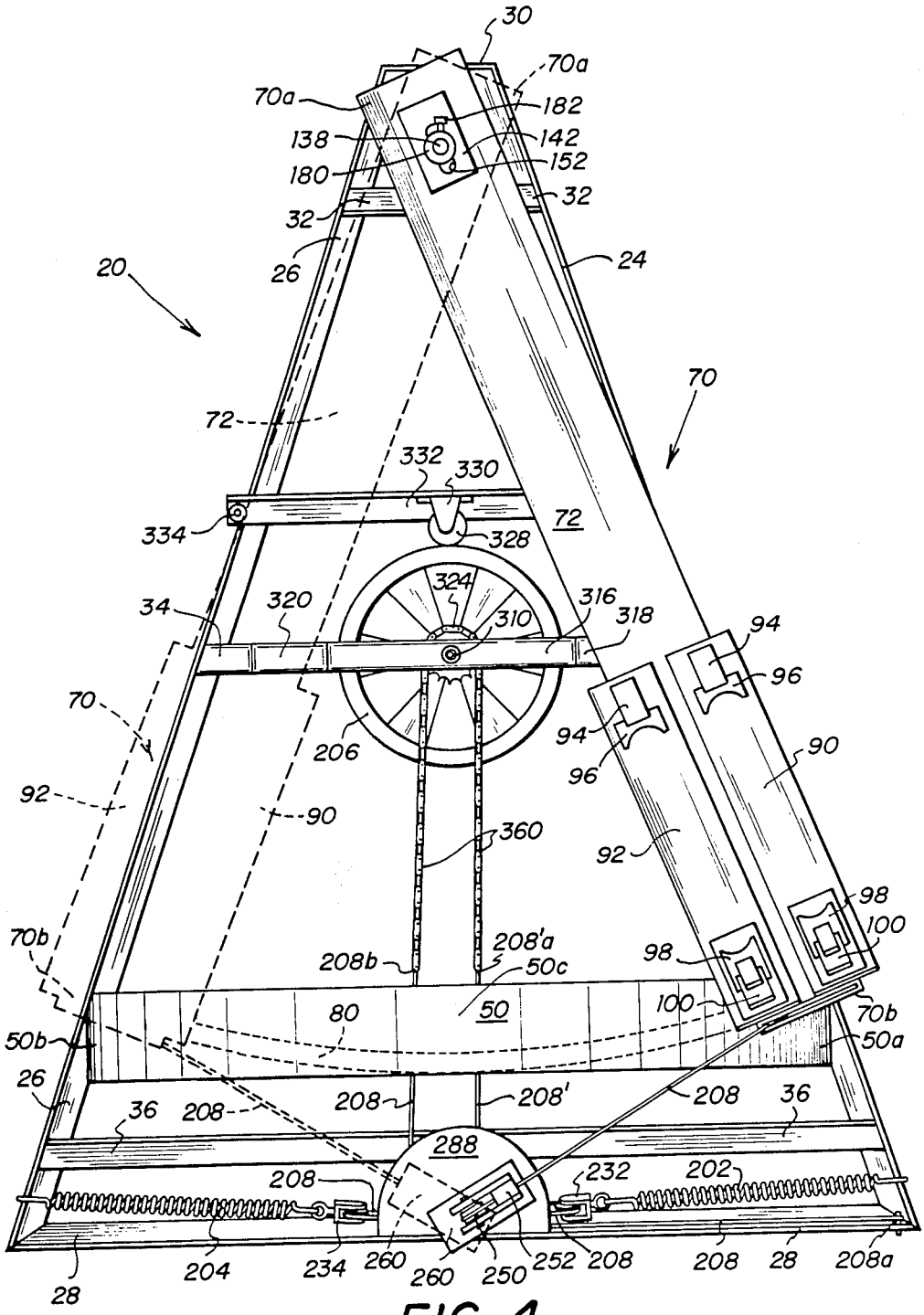
FIG. 4 is a top plan view of the ski exercising device illustrated in FIG. 1 showing the two outermost positions of the rail.

Pivotally interconnected adjacent to top frame member 30 of stationary mainframe 22 is a rail generally identified by the numeral 70. Rail 70 includes ends 70*a* and 70*b* and may be fabricated, for example, from an aluminum extrusion having a generally rectangular configuration in cross-section. Rail 70 has a top surface 72 and a bottom surface 74. Mounted adjacent to end 70*b* of rail 70 on bottom surface 74 is a bracket 76 (FIG. 2) for rotatably mounting a wheel 78. Bracket 76 supports wheel 78 along arcuate track 50 such that wheel 78 allows rail 70 to rotate along arcuate track 50 between ends 50*a* and 50*b* to the outermost positions of stationary mainframe 22 as illustrated in FIG. 4. Wheel 78 travels along arcuate track 50 along a path illustrated by dotted line 80 (FIG. 1 and 4) between ends 50*a* and 50*b* of arcuate track 50.

Still referring simultaneously to FIGS. 1, 2 and 3, the user of ski exercise device 20 places his boots 88 (FIG. 2) onto ski boot supports 90 and 92 which are mounted to top surface 72 of rail 70. The boots 88, illustrated in dotted lines of FIG. 2 are positioned on ski boot supports 90 and 92 where the user stands during use of the present ski exercise device 20. Ski boot supports 90 and 92 are positionable along rail 70 between ends 70*a* and 70*b* to accommodate skiers of various heights. For example, for shorter skiers having shorter skis, ski boot supports 90 and 92 would be located closer to end 70*a* of rail 70. As will subsequently be described, the user of ski exercise device 20 stands on ski boot supports 90 and 92 and causes rail 70 to rotate along arcuate track 50 between arcuate track 50 ends 50*a* and 50*b* during use of ski exercise device 20. Boot 88 is positioned on ski boot supports 90 and 92 between a bearing block 94 having a toe receiving portion 96 and a bearing block which is slidably adjustable to accommodate various sizes of ski boots in much the same way a ski boot is attached to a ski. Bearing block 98 includes a release lever 100 for slidably moving and locking bearing block 98 in place once boot 88 is positioned on ski boot supports 90 and 92. The operation of ski boot supports 90 and 92 will subsequently be described in connection with FIGS. 5–8.

Mounted adjacent to arcuate track 50 ends 50*a* and 50*b* along side members 24 and 26 of stationary mainframe 22 are stop members 110 and 112, respectively. Stop members 110 and 112, receive wheel 78 at the ends of the path of motion of wheel 78 and also cushion the impact of rail 70 at the outer boundaries of its motion.

Figure 11:
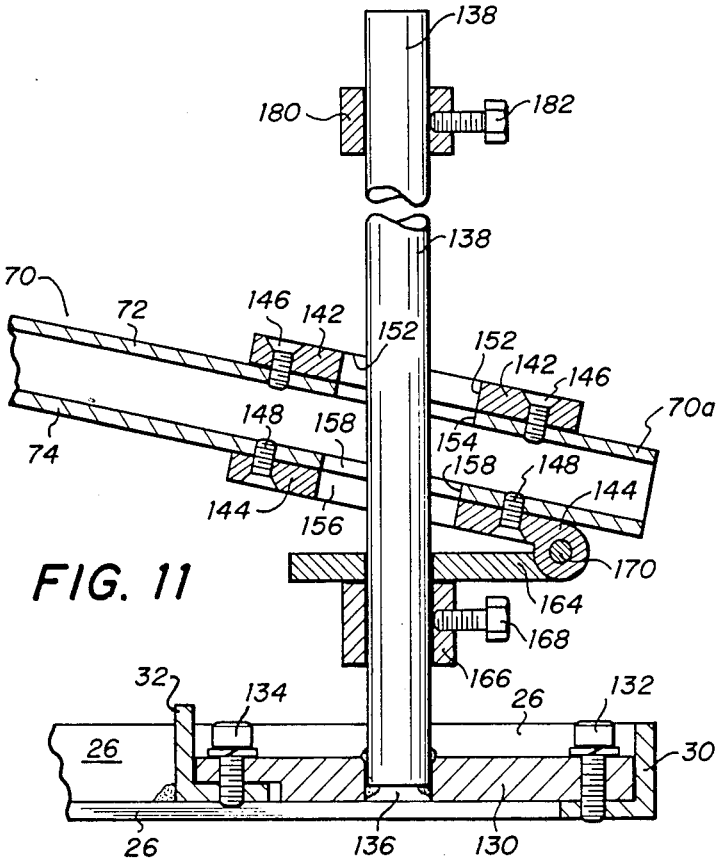
FIG. 11 is a cross-sectional view taken generally along sectional lines 11—11 of FIG. 1 illustrating the rail-frame pivotal mounting structure.

As previously stated, end 70*a* of rail 70 is pivotally mounted to stationary mainframe 22 which allows rail 70 to move along arcuate track 50. Referring simultaneously to FIGS. 1, 2 and 11, the pivotal interconnection of rail 70 to stationary mainframe 22 will now be discussed. Referring initially to FIG. 11, mounted between top frame member 30 and front transverse member 32 is a plate 130. Plate 130 is mounted to top frame member 30 and front transverse member 32 utilizing bolts 132 and 134 respectively. Plate 130 includes an aperture 136 through which a centrally disposed shaft 138 is mounted. Shaft 138 is welded to plate 130. Rail 70 is pivotally mounted to shaft 138 through the use of an upper mounting plate 142 and a lower mounting plate 144. Upper mounting plate 142 is mounted to the top surface 72 of rail 70 utilizing screws 146. Lower mounting plate 144 is mounted to bottom surface 74 of rail 70 utilizing screws 148. Upper mounting plate 142 includes a slotted aperture 152 which aligns with a slotted aperture 154 contained within top surface 72 of rail 70. Lower mounting plate 144 includes a slotted aperture 156 which aligns with a slotted aperture 158 in bottom surface 74 of rail 70. Apertures 152, 154, 156 and 158 allow rail 70 to move in a longitudinal direction with respect to shaft 138, that is in the direction of the longitudinal axis of rail 70 and not transverse to the longitudinal axis of rail 70 since these apertures are elongated slots as shown in FIGS. 1 and 4.

Lower mounting plate 144 is hingably attached to a shaft mounting plate 164 through a pin 170. Shaft mounting plate 164 and end 70*a* of rail 70 is mounted to shaft 138 through a collar 166 which allows for the positioning of end 70*a* of rail 70 in the vertical position along shaft 138 which changes the angle of inclination of rail 70. The steeper the angle, the more strenuous a workout the user will achieve using exercise device 20. Collar 166 is locked to shaft 138 using a bolt 168. Lower mounting plate 144 and shaft mounting plate 164 operate as a hinge to allow rail 70 to move in a vertical and horizontal direction as rail 70 moves between ends 50*a* and 50*b* of arcuate track 50. At the position of rail 70 at the ends of arcuate track 50, lower mounting plate 144 would be parallel to shaft mounting plate 164. Slotted apertures 152, 154, 156 and 158 in upper mounting plate 142, lower mounting plate 144 and rail 70 allow rail 70 to pivot around shaft 138 as rail 70 moves along arcuate track 50. Rail 70 during the course of this movement does not twist and top surface 72 moves through parallel planes which are generally parallel to the plane containing stationary mainframe 22. End 70*a* of rail 70 is locked to shaft 138 using a collar 180 and a locking bolt 182. Collar 180 is positioned on shaft 138 after rail 70 is assembled to shaft 138.

Referring again simultaneously to FIGS. 1 through 3 and now 4, ski exercise device 20 includes biasing structure generally identified by the numeral 200 for interconnecting end 70*b* of rail 70 to stationary mainframe 22. Biasing structure 200 provides a counterforce which must be overcome by the user of the present ski exercise device 20 as the user supported on ski boot supports 90 and 92 causes rail 70 to move along arcuate track 50. Biasing structure 200 biases rail 70 to a neutral position as illustrated in FIG. 1 in which wheel 78 is located at central portion 50*c* at the top of arcuate track 50. The user must overcome the force provided by biasing structure 200 in order to move rail 70 to the position adjacent side member 24 of stationary mainframe 22 shown in FIG. 4 in solid lines and to the position shown in dotted lines of rail 70 located adjacent side member 26 of stationary mainframe 22.

Biasing structure 200 includes springs 202, 204 and a flywheel 206 interconnected by a cable 208 and 208'. Cable 208 includes end 208*a* which is attached to base member 28 of stationary mainframe 22. Cable 208' includes end 208'*b* (FIG. 2) which passes through end 70*b* of rail 70 and is attached to rail 70 at a position below ski boot supports 90 and 92 using a bolt 220 (FIG. 2). Spring 202 has one end attached to side member 24 and is interconnected at its other end to a pulley 230. Spring 204 has one end connected to side member 26 in its other end interconnected to a pulley 232.

Biasing structure 200 further includes a wheel 236 mounted to a leg 238 (FIGS. 2 and 3) which is interconnected to base member 28. Also attached to leg 238 is a wheel 240 (FIG. 3). Biasing structure 200 further includes a wheel 242 (FIG. 3) interconnected to a bracket 244 which is interconnected to a leg 246. Leg 246 is interconnected to base member 28.

Figure 9:
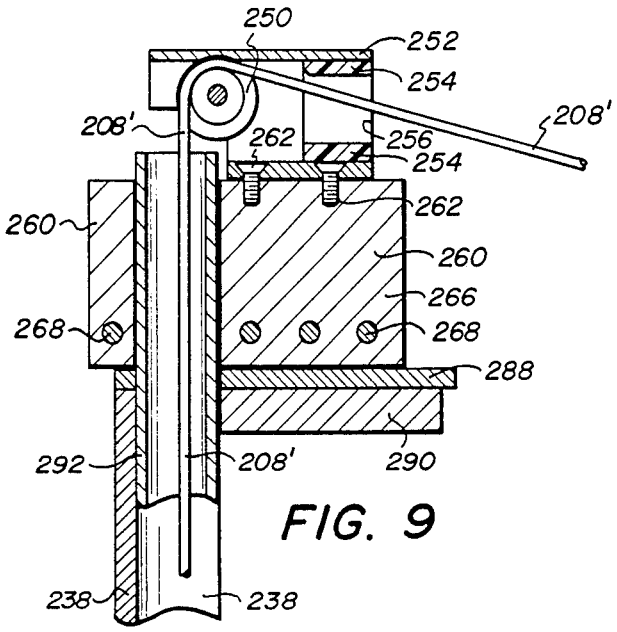
FIG. 9 is a cross-sectional view taken generally along sectional lines 9—9 of FIG. 1 illustrating a cable housing.
Figure 10:
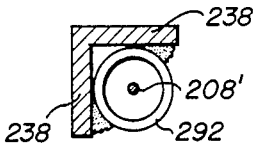
FIG. 10 is a cross-sectional view taken generally along sectional lines 10—10 of FIG. 2 illustrating the cable housing.

Referring simultaneously to FIGS. 1, 9 and 10, biasing structure 200 further includes a wheel 250 which is mounted to a bracket 252. Bracket 252 includes a bushing 254 positioned in an aperture 256 through which cable 208 passes. Bracket 252 is mounted to a block 260 using screws 262. Block 260 includes sidewalls 264 and 266 (FIG. 1) interconnected by fasteners 268. Sidewalls 264 and 266 of block 260 are supported on a support plate 288. Support plate 288 is attached to a brace 290 which is interconnected to legs 238 and 58. Cable 208' extends through support plate 288 to engage wheel 250. Positioned through support plate 288 and attached to leg 238 is a bushing 292 through which cable 208' passes Biasing structure 200 further includes flywheel 206 which is rotatably mounted to central transverse member 34 of stationary mainframe 22 on a shaft 310. Flywheel 206 rotates in a plane parallel to stationary mainframe 22. Shaft 310 (FIGS. 2 and 4) mounts flywheel 206 to central transverse member 34 and a mounting bracket 314 having a top member 316 and side members 318 and 320. Mounted to shaft 310 is a ratchet wheel 324 (FIG. 4) through which motion is imparted to flywheel 206. Flywheel 206 also includes a tensioning device generally identified by numeral 326. Tensioning device 326 includes a wheel 328 (FIG. 4) which bears against the surface of flywheel 206 to increase or decrease the amount of effort required to turn flywheel 206. Wheel 328 is mounted to a bracket 330 which in turn is mounted to a transverse member 332 extending between side members 24 and 26 of stationary mainframe 22. Transverse member 332 is pivotally mounted to side member 26 using a bolt 334. Positioning of transverse member 332 with respect to central transverse member 34 is controlled by a tension adjustment rod 340 which extends between transverse member 332 and central transverse member 34. Rod 340 is interconnected to mounting bracket portion 318 at one end and at its other end passes through a bracket 344 which is attached to transverse member 332. The end of rod 340 passing through bracket 344 includes a spring 346 whose position is controlled by an adjustment knob 348. The tensioning of spring 346 against bracket 344 causes pivotal movement of transverse member 332 about bolt 334 towards and away from central transverse member 34 to cause wheel 328 to engage flywheel 206.

The operation of biasing structure 200 will now be described. Referring again to FIGS. 1 through 4, cable 208 extends from its point of attachment, 208*a* to base member 28 to wheel 236 attached to leg 238 (FIG. 3). Cable 208 then passes around wheel 238 to pulley 230 which is attached to spring 202 (FIGS. 1 and 3). After passing around pulley 230, cable 208 passes between leg 238 and leg 58 to pulley 232 attached to spring 204. Cable 208 after passing around pulley 232 passes around wheel 242 attached to leg 246. Cable 208 passes around wheel 242 in the direction of flywheel 206. Cable 208 is then interconnected at end 208*b* to a chain 360 (FIGS. 2 and 4) which extends around ratchet 324. The other end of chain 360 is attached to end 208'*a* of second cable 208' which extends to wheel 240 (FIG. 2). Cable 208' then extends upwardly through bushing 292 (FIGS. 2 and 9) to engage wheel 250. Cable 208' after engaging wheel 250 passes through bushing 254 to connect to rail 70 at bolt 220 (FIG. 2).

It therefore can be seen that as rail 70 moves between its two extreme positions adjacent side members 24 and 26, cable 208 is displaced as springs 202 and 204 expand which in turn causes chain 360 to move and rotate flywheel 206 through ratchet 324. As rail 70 is moved by the user of ski exercise device 20 to the positions shown in FIG. 4, springs 202 and 204 will expand to their full extent such that pulley 232 lies adjacent to wheel 242 (FIG. 3) and pulley 234 lies adjacent to wheel 242 (FIG. 3). The energy stored in springs 202 and 204 in their expanded position will then cause rail 70 to move to the neutral position of rail 70 at central portion 50*c*. The repeated expansion and contraction of springs 202 and 204 occurs as rail 70 moves between positions shown in FIG. 4 as rail 70 moves along arcuate track 50.

The user of ski exercise device 20 must overcome the forces of springs 202 and 204 in order to move rail 70 between the two positions shown in FIG. 4 since springs 202 and 204 and cables 208 and 208' tend to move rail 70 to the neutral position shown in FIG. 1. Additional force required to move rail 70 which must be overcome by the user of ski exercise device 20 is created by flywheel 206. The amount of force exerted by flywheel 206 is controlled by the positioning of wheel 328 which provides friction which must be overcome in order to turn flywheel 206 as rail 70 moves along arcuate track 50. The forces established by biasing structure 200 which must be overcome by the user of ski exercise device 20 provide a conditioning and muscular activity of the user for ski exercise device 20. As the user moves along arcuate track 50, biasing structure 200 simulates the up-and-down movement associated with downhill skiing as the skier unweights the skis as he moves up and down. The up movement or unweighting occurs as biasing structure 200 returns rail 70 to the neutral position, and the weighting or down motion occurs as rail 70 is moved along arcuate track 50 to the end positions 50*a* and 50*b* as shown in FIG. 4.

The simulation of stressing the outer ski in a curve with the simultaneous lowering of the outer ski, inclination of the skis or edge setting and the longitudinal shifting of the feet of the skier with the inner ski located ahead of the outer ski in a turn that can be simulated utilizing ski exercise device 20 will now be discussed. Referring simultaneously to FIGS. 2–8, ski boot supports 90 and 92 are slidably mounted for simultaneous movement in a longitudinal direction along rail 70 as well as rotationally mounted for rotation about the axis of rail 70. Each ski boot support 90 and 92 is identically mounted to rail 70 and therefore, a single reference numeral will be utilized for common components in the mounting structures. Each ski boot support 90 and 92 is independently mounted for movement along and about rail 70. Interconnected to rail 70 through the top surface 72 and extending through rail 70 is a T-member 398. T-member 398 includes a plate 400 disposed adjacent to top surface 72 of rail 70 and a vertical portion 402 which extends through rail 70 and which is affixed to rail 70 by bolt 220. A bracket 404 is mounted to plate 400 using bolts 406. A bracket 408 is mounted to plate 400 using bolts 410. Brackets 404 and 408 include an aperture through which a shaft 412 is received. Shaft 412 is slidable within brackets 404 and 408.

Mounted to ski boot supports 90 and 92 are brackets 420 and 424 utilizing bolts 422 and 426, respectively. An aperture within brackets 420 and 424 allows shaft 412 to be received by brackets 420 and 424 such that ski boot supports 90 and 92 longitudinally move with respect to the ends of rail 70 as well as allows ski boot supports 90 and 92 to simultaneously rotate about the longitudinal axis of rail 70.

Figure 5:
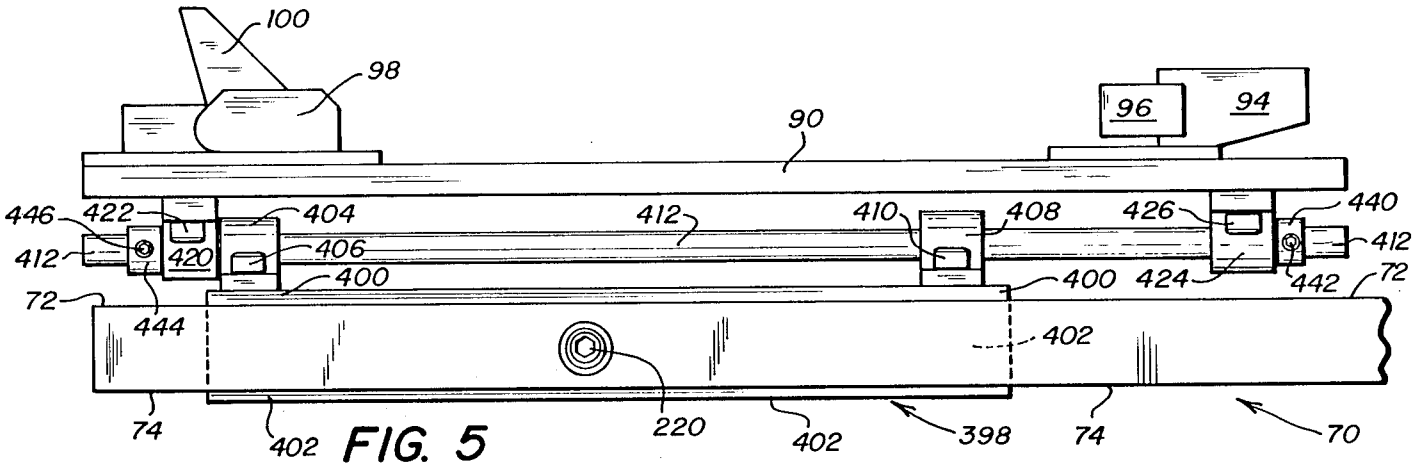
FIG. 5 is an enlarged side elevational view of the boot platform in the forward position.
Figure 6:
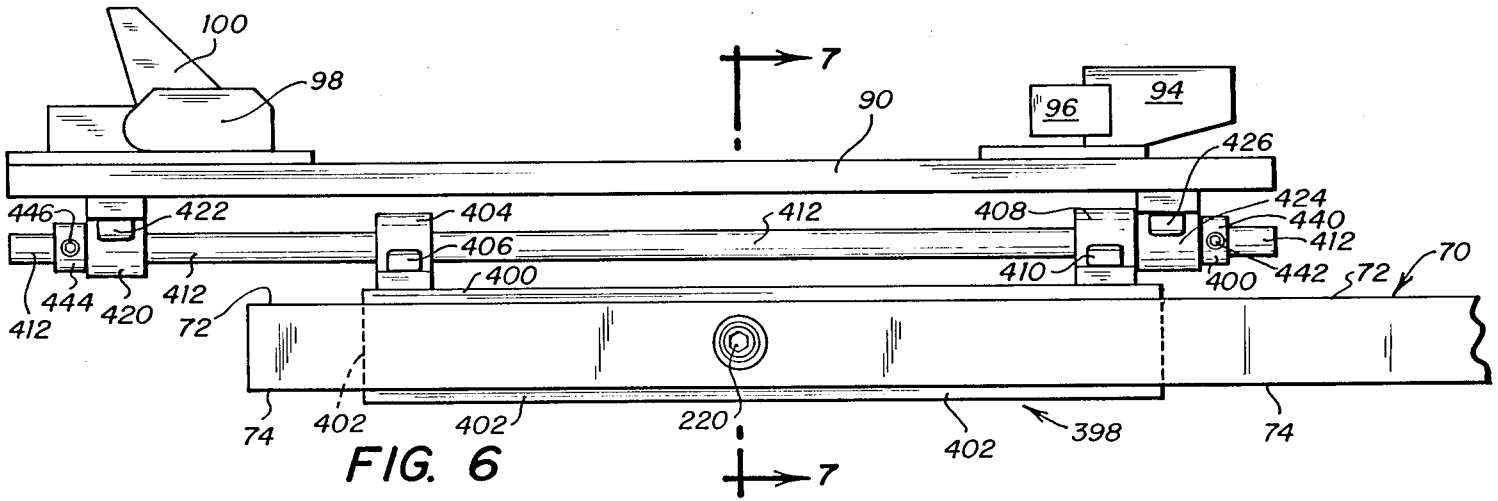
FIG. 6 is an enlarged side elevational view of the boot platform in the rearmost position.
Figure 7:
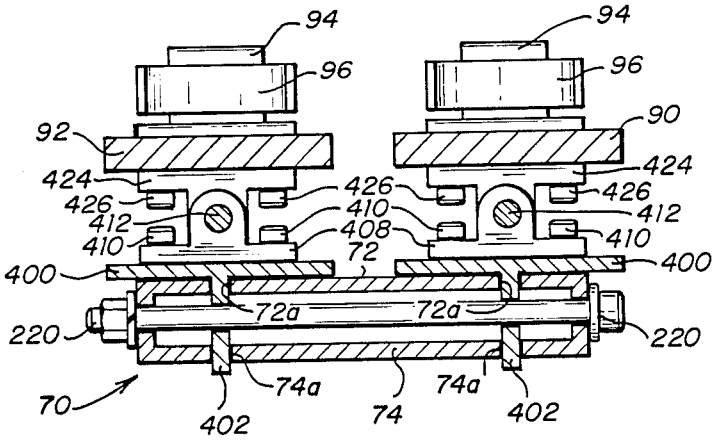
FIG. 7 is a cross-sectional view of the boot platform taken generally along sectional lines 7—7 of FIG. 6.

As shown in FIGS. 5 and 6, shaft 412 longitudinally moves between a forwardmost position as shown in FIG. 5 and a rearwardmost position as shown in FIG. 6 to allow the user of ski exercise device 20 to shift his feet forward and back simulating foot movement in a turn. Since ski boot supports 90 and 92 operate independently of each other, the feet of the user can be moved relative to each other such that one foot can either be parallel to, behind or forward of the other along rail 70 as rail 70 moves along track 50.

Ski boot supports 90 and 92 are retained on shaft 412 using a forward collar 440 and locking bolt 442 and a rearward collar 444 and locking bolt 446.

Figure 8:
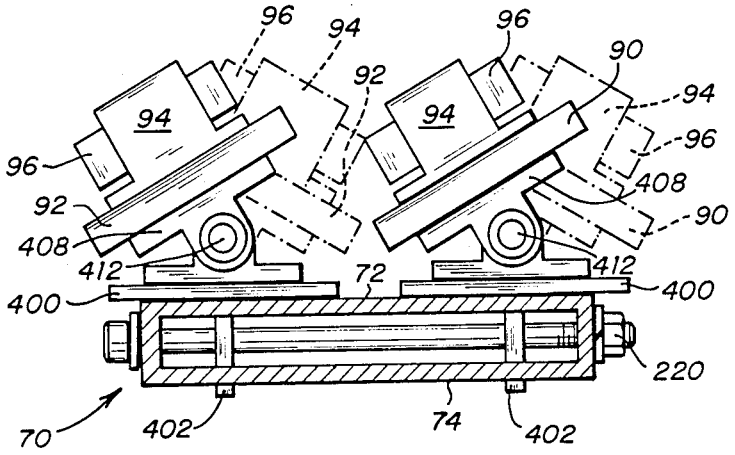
FIG. 8 is a sectional view taken generally along sectional lines 8—8 of FIG. 2 illustrating the rotational positions of the boot platforms.

FIG. 8 illustrates the rotational motion of ski boot supports 90 and 92 which allows the user of ski exercise device 20 to simulate stressing of the outer ski in a curve with the lowering of the outer ski, and inclination of the skis so that their edges are in contact with the snow in a turn. Ski boot supports 90 and 92 rotate about shaft 412 such that ski boot support 90 rotates between the solid line position shown in FIG. 8 and the dashed line shown in FIG. 8. Ski boot support 92 rotates about shaft 412 from the solid line position shown in FIG. 8 to the dotted-dashed line shown in FIG. 8. The rotational movement of ski boot supports 90 and 92 simulates the skier skiing on the edges of his skis in a turn while skiing downhill and occurs simultaneously with the longitudinal movement of ski boot supports 90 and 92 shown in FIGS. 5 and 6.

Figure 12:
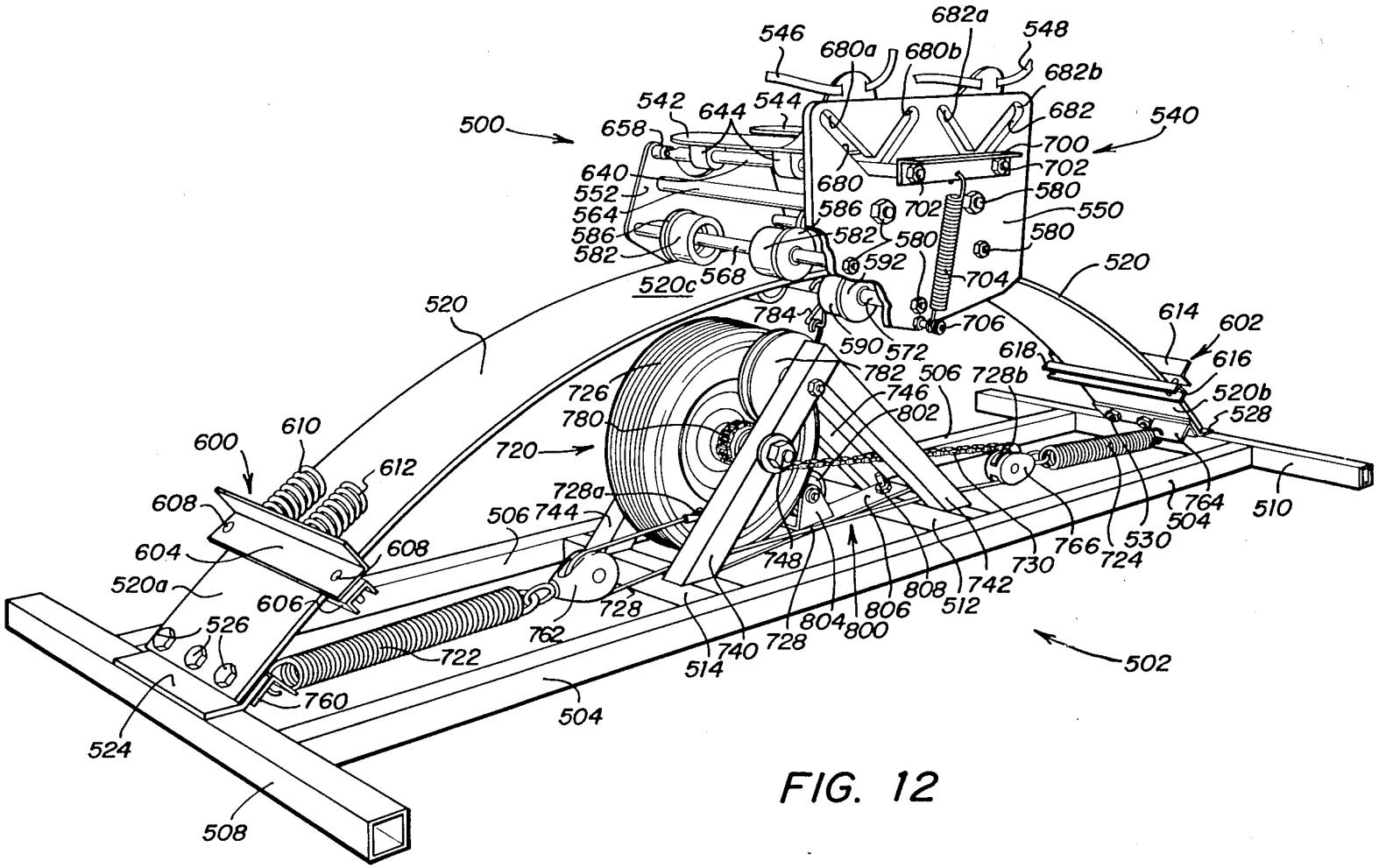
FIG. 12 is a perspective view of the ski exercising device of the present invention.
Figure 13:
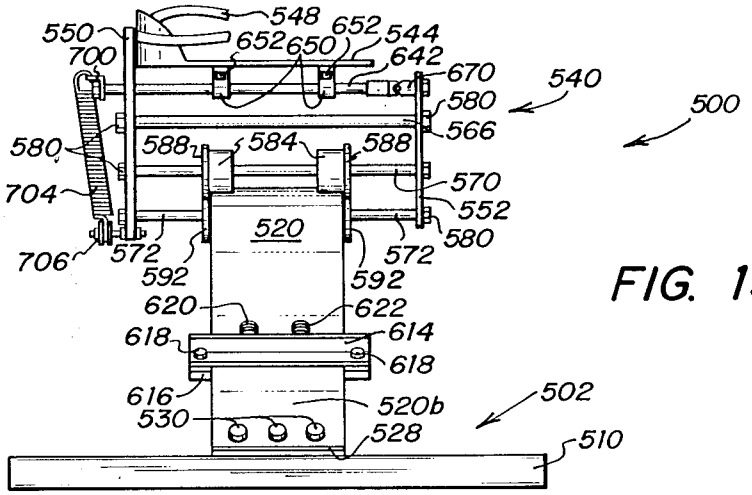
FIG. 13 is an end view of the ski exercising device illustrated in FIG. 12.
Figure 14:
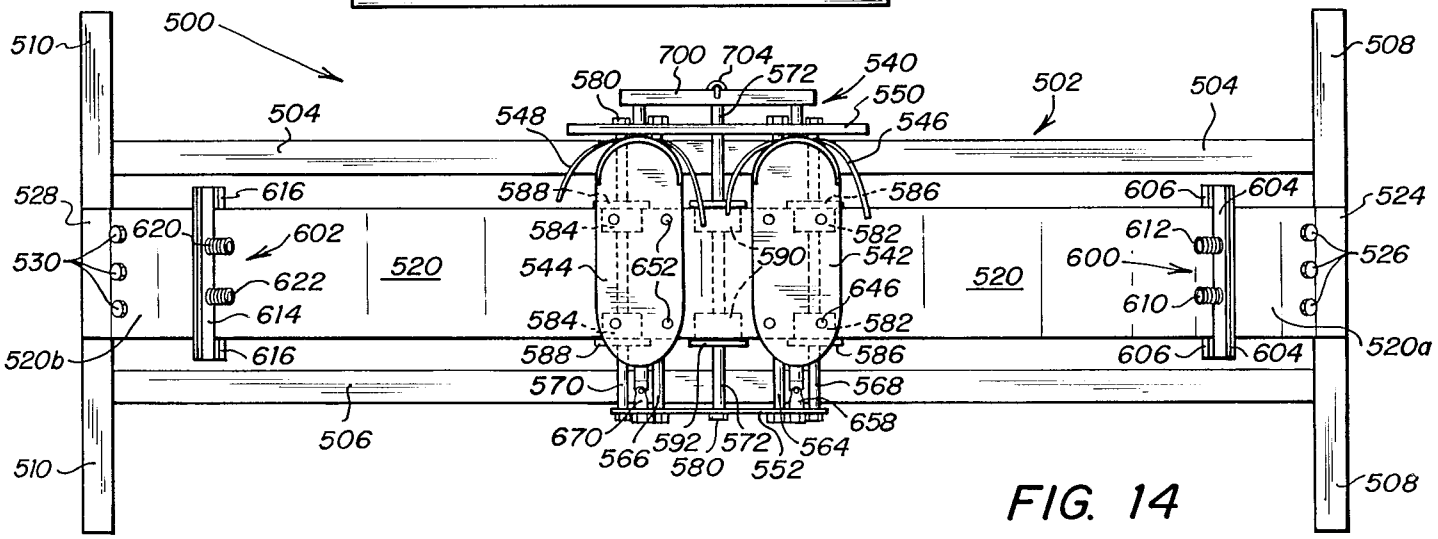
FIG. 14 is a top plan view of the ski exercising device illustrated in FIG. 12.

Referring simultaneously to FIGS. 12, 13, and 14, the present ski exercise device is illustrated and is generally identified by the numeral 500. Ski exercise device 500 is similar to ski exercise device 20 described in FIG. 1–11 and can be used for the practice and simulation of skiing, especially for the practice of downhill or slalom runs and for exercising those parts of the body whose conditioning is especially important for a safe and satisfactory downhill ski run. The ski exercise device 500 includes a stationary mainframe, generally identified by the numeral 502 which is disposed in a first plane and which is positioned on the floor for use. Stationary mainframe 502 is generally rectangular in configuration and includes side members 504 and 506 which are interconnected by end members 508 and 510. Also interconnecting side members 504 and 506 of stationary mainframe 502 are central transverse members 514 and 512. The members 504–514 of stationary mainframe 502 may be interconnected by welding, nuts and bolts, or the like.

Ski exercise device 500 includes an arcuately shaped track 520 having ends 520*a* and 520*b* and a central portion 520*c*. Arcuate track 520 is disposed in a second plane generally perpendicular to the plane of stationary mainframe 502. The highest point on arcuate track 520 is central portion 520*c*. Arcuate track 520 is attached to end members 508 and 510 at ends 520*a* and 520*b*, respectively. End 520*a* of arcuate track 520 is attached to end member 508 using a bracket 524 which is welded to end member 508 and bolts 526. In a similar manner, end 520*b* of arcuate track 520 is attached to end member 510 using a bracket 528 which is welded to end member 510 and bolts 530 (FIG. 13).

Slidably mounted on arcuate track 520 is a support platform generally identified by the numeral 540. Support platform 540 includes foot supports 542 and 544 for supporting the feet of the user of ski exercise device 500. The feet of the user of ski exercise device 500 are strapped to foot supports 542 and 544 using straps 546 and 548, respectively, which may be attached with buckles or Velcro strips. Support platform 540 is slidably mounted to arcuate track 520 and travels along arcuate track 520 between ends 520*a* and 520*b* during use of ski exercise device 500. Support platform 540 includes plates 550 and 552. Plates 550 and 552 are interconnected at their upper portion by rods 564 and 566, centrally by rods 568 and 570, at a lower portion by rod 572. Rods 564–572 rigidly interconnect plates 550 and 552 and are secured to plates 550 and 552 utilizing bolts 580.

Mounted to rods 568 and 570 are a pair of rollers 582 and 584, respectively. Rollers 582 and 584 include a flanged portion 586 and 588, respectively which engage the sides of arcuate track 520 to maintain support platform 540 transversely disposed along arcuate track 520. Disposed on rod 572 are a pair of rollers 590 having a flange 592. Flange 592 engages the side of arcuate track 520 and further maintains support platform 540 transversely disposed on arcuate track 520. The combination of rollers 582, 584, and 590 allows support platform 540 to move longitudinally along arcuate track 520 between ends 520*a* and 520*b*. Further, since rollers 570 engage arcuate track 520 from the bottom surface of arcuate track 520, support platform 540 is slidably attached to arcuate track 520 and cannot be removed from arcuate track 520 unless rod 572 is removed from between plates 550 and 552.

Mounted adjacent to ends 520*a* and 520*b* of arcuate track 520 are stop members, generally identified by the numerals 600 and 602. Stop members 600 and 602 receive rods 568 and 570, respectively at the ends of the path of motion of support platform 540 and cushion the impact of support platform 540 at the outer boundaries of its motion. Stop member 600 includes top and bottom brackets 604 and 606 interconnected by bolts 608. Welded to top bracket 604 are springs 610 and 612. Similarly configured is stop member 02 which includes top and bottom brackets 614 and 616 interconnected by bolts 618. Welded to top bracket 614 are springs 620 and 622.

Foot supports 542 and 544 are interconnected to support platform 540 utilizing shafts 640 (FIG. 12) and 642 (FIG. 13), respectively. Foot support 542 is rotatably mounted to shaft 640 utilizing a pair of brackets 644 and bolts 646 (FIG. 14). Similarly, foot support 544 is rotatably mounted to shaft 642 utilizing a pair of brackets 50 and bolts 652 (FIG. 13). Shafts 640 and 642 are mounted to plate 552 for rotational as well as lateral movement utilizing universal joints 658 (FIG. 12) and 670 (FIGS. 13, 14), respectively. Shafts 640 and 642 extend through plate 550 of support platform 540 and are disposed within slotted channels 680 and 682, respectively. Slotted channels 680 and 682 are generally "V" shaped having a rounded vertex in which shafts 640 and 642 translate as support platform 540 moves between ends 520*a* and 520*b* of arcuate track 520. Shafts 640 and 642 are interconnected adjacent plate 550 of support platform 540 utilizing a bracket 700 and nuts 702. Bracket 700 is biased to plate 550 utilizing a spring 704 which is interconnected between bracket 700 and plate 550. Spring 704 is interconnected to plate 550 utilizing a bolt 706.

During use of the present ski exercise device 500, when support platform 540 is positioned adjacent to end 520*a* of arcuate track 520, foot supports 542 and 544 rotate about shafts 640 and 642 in the direction of end 520*a* of arcuate track 520. Simultaneous with this rotation, shafts 640 and 642 translate in the vertical direction within slotted channels 680 and 682 overcoming the bias force of spring 704, such that shafts 640 and 642 are disposed adjacent to ends 680*a* and 682*a* of slotted channels 680 and 682, respectively. Similarly, when support platform 540 is disposed adjacent end 520*b* of arcuate track 520, foot supports 542 and 544 rotate about shafts 640 and 642 in the direction of end 520*b* of arcuate track 520. Simultaneous with this rotation, shafts 640 and 642 translate within slotted channels 680 and 682 in the vertical direction, overcoming the bias force of spring 704, such that shafts 640 and 642 lie adjacent ends 680*b* and 682*b* of slotted channels 680 and 682, respectively. The simultaneous rotation of foot supports 542 and 544 as well as their vertical displacement with respect to support platform 540 simulates the up-and-down movement associated with downhill skiing as the skier unweighs the skis as he moves up and down as well as the stressing of the outer ski in a curve with the lowering of the outer ski and edge setting due to rotation of foot supports 542 and 544. This entire motion also takes place as support platform 540 moves between ends 520*a* and 520*b* of arcuate track 520. As support platform 540 moves between ends 520*a* and 520*b* of arcuate track 520, spring 704 extends and allows foot supports 542 and 544 to move within slotted channels 680 and 682. As support platform 540 returns to the central portion 520*c* of arcuate track 520, spring 704 contracts to move shafts 640 and 642 to the bottom position of slotted channels 680 and 682.

Referring specifically to FIG. 12, the present ski exercise device 500 includes biasing structure, generally identified by the numeral 720 which is interconnected between support platform 540 and stationary mainframe 502. Biasing structure 720 provides a counterforce which must be overcome by the user of the present ski exercise device 500 as the user supported by support platform 540 and foot supports 542 and 544 causes support platform 540 to move along arcuate track 520. Biasing structure 720 biases support platform 540 to a neutral position as illustrated in FIG. 12 in which support platform 540 is located at central portion 520*c* at the top of arcuate track 520. The user must overcome the force provided by biasing structure 720 in order to move support platform 540 to the ends 520*a* and 520*b* of arcuate track 520.

Biasing structure 720 includes springs 722, 724 and a flywheel 726 interconnected by a cable 728 and chain 730. Flywheel 726 is rotatably supported below arcuate track 520 utilizing legs 740, 742, 744, and 746 which are interconnected to transverse members 514 and 512 of stationary mainframe 502. Flywheel 726 is rotatably mounted to legs 740 and 744 utilizing an axle 748.

Spring 722 is interconnected to bracket 524 via a bracket 760. The opposite end of spring 722 is interconnected to a pulley 762. Spring 724 is interconnected to bracket 528 via a bracket 764 and has its opposite end interconnected to a pulley 766. Cable 728 having ends 728*a* and 728*b* extends between pulleys 762 and 766. End 728*a* of cable 728 is interconnected to leg 740. Cable 728 passes around pulleys 762 and 766. End 728*b* of cable 728 is interconnected to chain 730. Chain 730 is interconnected to flywheel 726 through a ratchet 780 and is held around ratchet 780 utilizing a pressure roller 782. Chain 730 is disposed around ratchet 780 and around pressure roller 782. End 730*b* of chain 730 is interconnected to shaft 572 of support platform 540 utilizing a clip 784.

Flywheel 726 rotates in a plane generally perpendicular to a plane containing stationary mainframe 502 and rotates due to the movement of support platform 540 along arcuate track 520 between ends 520*a* and 520*b*. When support platform 540 is positioned adjacent either end 520*a* or 520*b* of arcuate track 520, springs 722 and 724 are in their maximum extended position such that pulleys 762 and 766 lie adjacent to legs 740 and 742, respectively. As springs 722 and 724 contract, support platform 540 is returned to the neutral or central position 520*c* along arcuate track 520. The repeated expansion and contraction of springs 722 and 724 occurs as support platform 540 moves between the ends of arcuate track 520.

The user of ski exercise device 500 must overcome the forces of springs 722 and 724 in order to move support platform 540 between the ends of arcuate track 520. Additional force required to move support platform 540 which must be overcome by the user of the present ski exercise device 500 is created by flywheel 726. The amount of force exerted by flywheel 726 is controlled by a tensioning device 800 which includes a wheel 802 which bears against the surface of flywheel 726 to increase or decrease the amount of effort required to turn flywheel 726. Wheel 802 is mounted to a bracket 804 which in turn is mounted to a plate 806. Plate 806 is mounted to transverse member 512 utilizing a bolt 808. The amount of torque applied to bolt 808 controls the amount of tensioning applied by wheel 802 to flywheel 726 and therefore determines the amount of force required to turn flywheel 726.

As the user moves along arcuate track 520, biasing structure 720 simulates the up-and-down movement associated with downhill skiing as the skier unweighs the skis as he moves up and down. The up movement or unweighing occurs as biasing structure 720 returns support platform 540 to the neutral position, and the weighing or down motion occurs as support platform 540 is moved along arcuate track 520 to the end positions 520*a* and 520*b*.

It therefore can be seen that the present invention provides for an exercise device simulating downhill skiing. The present exercise device allows the user to simulate many of the movements required in downhill skiing including the up-and-down movement, stressing of the outer ski in a curve with the lowering of the outer ski and edge setting. The present invention provides various levels of muscular activity due to the adjustable feature of the biasing structure which generates forces that the user must overcome while using the exercise device.

Whereas the present invention has been described with respect to specific embodiments thereof, it will be understood that various changes and modifications will be suggested to one skilled in the art and it is intended to encompass such changes and modifications as fall within the scope of the appended claims.

I claim:

1. A ski exercise device comprising:

a frame;

a track having first and second ends, said ends of said track being connected to said frame;

means slidably mounted to said track for supporting the user of the device, such that said support means moves along said track between said first and second ends of said track;

a flywheel rotatably mounted to said frame;

a cable interconnecting said flywheel and said support means;

means for biasing said support means to said frame, said support means having a neutral position when located centrally between said track first and second ends and being movable along said track between said first and second ends thereof by the user of the device by overcoming the force exerted by said biasing means and said flywheel to thereby impart rotational motion to said flywheel.

2. The ski exercise device of claim 1 wherein said frame lies in a first plane and said track lies in a second plane generally perpendicular to said first plane.

3. The ski exercise device of claim 1 wherein said support means includes:

a platform for receiving the feet of the user of the device, said platform being mounted to said track for slidable longitudinal motion along said track between said first and second ends and for rotational motion with respect to said track.

4. A ski exercise device comprising:

a frame disposed in a first plane;

an arcuate track having first and second ends and a central portion disposed between said ends, said ends of said arcuate track being connected to said frame and said arcuate track being disposed in a second plane generally perpendicular to said first plane with said central portion being disposed above said first plane;

means slidably mounted to said track for supporting the user of the device and including means for engaging said arcuate track, such that said support means moves along said arcuate track between said first and second ends thereof;

a flywheel rotatably mounted to said frame;

a cable interconnecting said flywheel and said support means;

means for biasing said support means to said frame, said support means having a neutral position when located centrally between said track first and second ends and being movable along said track between said first and second ends thereof by the user of the device by overcoming the force exerted by said biasing means and said flywheel to thereby impart rotational motion to said flywheel.

5. The ski exercise device of claim 4 wherein said means for engaging said arcuate track include roller means.

6. The ski exercise device of claim 4 wherein said support means includes:

a platform for receiving the feet of the user of the device, said platform being mounted to said arcuate track for slidable longitudinal motion along said arcuate track between said first and second ends and rotational motion with respect to said arcuate track.

7. The ski exercise device of claim 6 wherein said biasing means includes spring means interconnected between said frame and said support means.

8. A ski exercising and simulating device comprising:

a frame having first and second ends and lying in a first plane;

an arcuate track having first and second ends and a central portion disposed between said ends, said ends of said arcuate track being connected to said frame adjacent said first end of said frame, said arcuate track being disposed in a second plane generally perpendicular to said first plane with said central portion thereof being disposed above said first plane;

a support platform for receiving the feet of the user of the device, said support platform being mounted to said arcuate track between said first and second ends for slidable longitudinal motion along said arcuate track and rotational motion about said arcuate track to allow the feet of the user of the device to move back and forth between said arcuate track first and second ends as well as to rotate in the direction of movement of said support platform along said arcuate track thereby simulating up and down movements and edge setting;

a flywheel rotatably mounted to said frame; and a cable interconnecting said flywheel and said support platform;

means for biasing said support platform to said frame, said support platform having a neutral position when located adjacent said central portion of said arcuate track and being movable along said arcuate track between said first and second ends thereof by the user of the exercising and simulating device by overcoming the force exerted by said biasing means and said flywheel to thereby impart rotational motion to said flywheel.

9. The ski exercising and simulating device of claim 8 and further including:

means for controlling the amount of resistance offered by said flywheel to the movement of said support platform.

10. The ski exercising and simulating device of claim 9 wherein said biasing means includes spring means interconnected to said cable.

11. The ski exercising and simulating device of claim 10 wherein said spring means includes:

first and second springs, such that said springs extend when said support platform moves to said first and second ends of said arcuate track.

* * * * *